US005715789A

United States Patent [19]

Naruke et al.

[11] Patent Number: 5,715,789

[45] Date of Patent: Feb. 10, 1998

[54] METHOD FOR CONTROLLING ENGINE FOR MODEL AND DEVICE THEREFOR

[75] Inventors: Giichi Naruke; Michio Fujisaki, both of Mobara; Akira Kaneko; Yutaka Ueda, both of Osaka, all of Japan

[73] Assignees: Futaba Denshi Kogyo K.K., Mobara; Ogawa Seiki K.K., Osaka, both of Japan

[21] Appl. No.: 648,250

[22] Filed: May 15, 1996

[30] Foreign Application Priority Data

May 17, 1995 [JP] Japan ..... 7-141359

[51] Int. Cl.[6] ..... F02D 41/10; F02D 41/12

[52] U.S. Cl. ..... 123/320; 123/344; 123/438; 123/DIG. 3

[58] Field of Search ..... 123/320, 325, 123/344, 438, DIG. 3, 682

[56] References Cited

U.S. PATENT DOCUMENTS 4,240,390 12/1980 Takeda ..... 123/682
4,411,233 10/1983 Chenet et al. ..... 123/438

*Primary Examiner*—Andrew M. Dolinar
*Attorney, Agent, or Firm*—Oblon, Spivak, McClelland, Maier & Neustadt, P.C.

[57] ABSTRACT

A method for controlling an engine for a model and a device therefor capable of improving throttle response. Feed of fuel to the engine is increased during acceleration of the engine and decreased during deceleration thereof. This permits a rotational speed of the engine to be smoothly and rapidly varied, to thereby reduce vibration of the engine and prevent knocking and breathing of the engine. Also, adjustment of a trim provided on a side of a controller leads to adjustment of a needle valve, so that the adjustment may be facilitated.

9 Claims, 5 Drawing Sheets

METHOD FOR CONTROLLING ENGINE FOR MODEL AND DEVICE THEREFOR

BACKGROUND OF THE INVENTION

This invention relates to a method for controlling an engine for a model and a device therefor, and more particularly to a method for controlling a rotational speed of an engine for a model and a device therefor.

Setting of an engine for a model (hereinafter also referred to as "model mounted engine") is carried out so as to ensure safe revolution of the engine during idling, as well as in a region of each of a middle engine speed and a high engine speed. For this purpose, a conventional model mounted engine is so constructed that a rotational speed of the engine is controlled by operation of only a throttle valve of a carburetor. Thus, during setting of the engine, a needle valve is so adjusted that the engine generates power in a region of an increased engine speed.

Thus, although the engine constructed as described above provides desired power in a region of an increased rotational speed, it renders the needle valve excessively open with a decrease in engine speed due to closing of the throttle valve, to thereby cause mixed gas of air and fuel fed to the engine to be excessively increased in concentration thereof, leading to overcharge of the engine.

Whereas, during setting of the engine, when the needle valve is so adjusted that the engine may stably revolve in a low rotational speed region, opening of the throttle valve for increasing a rotational speed of the engine causes a concentration of mixed gas fed to the engine to be excessively reduced, leading to breathing of the engine.

Such a phenomenon is caused due to the fact that a mixing ratio at which air and fuel are mixed together is not suitably set with respect to an engine speed or a rotational speed of the engine. In order to solve such a problem, techniques for automatically adjusting a degree of opening of the needle valve so as to permit the mixing ratio to be appropriately set relative to a degree of opening of the throttle valve were proposed, as disclosed in Radio Control Techniques, Vol. 34, No. 8 (Whole No. 474), pp 218–222 (July, 1994).

The model mounted engine control techniques proposed ensure satisfactory feeding of mixed gas in which air and fuel are mixed at a suitable mixing ratio to the engine at any engine speed extending from idling to a high rotational speed, to thereby permit the engine to carry out stable revolution over a wide engine speed region.

When a stick for engine control in a radio control transmitter is hard operated while keeping the engine mounted on a model such as a model airplane or the like, a degree of opening of each of a throttle valve and a needle valve is varied depending on the amount of operation of the stick. Also, the amount of air introduced to the model mounted engine is apt to follow opening of the throttle valve, whereas the amount of fuel introduced thereto is determined depending on opening of the needle valve while being affected by the amount of air introduced into the engine, a flow rate of the air and the like, to thereby be delayed in follow as compared with the air.

Also, a rotational speed of the engine fails to be instantaneously changed because of being affected by its own inertia, a load applied to the engine and the like, so that a significant length of time is required to stabilize feeding of air and fuel to the engine. The engine is kept from being fed with mixed gas consisting of air and fuel suitably mixed together during a period of time for which the rotational speed is varied.

Thus, when the engine is hard operated so as to increase an engine speed or a rotation speed of the engine, the mixed gas is caused to be decreased in concentration, resulting in knocking of the engine or breathing thereof, leading to stalling of the engine in the worst case.

Further, when the stick of the radio control transmitter is operated to control a degree of opening of the throttle valve, the throttle valve is delayed in response, so that an increase in rotational speed of the engine to a desired level requires a considerable amount of time.

In addition, viscosity of fuel is varied depending on a temperature thereof, so that the viscosity is hard to be adjusted. Furthermore, the engine is increased in vibration during control, to thereby be apt to be disordered.

SUMMARY OF THE INVENTION

The present invention has been made in view of the foregoing disadvantage of the prior art.

Accordingly, it is an object of the present invention to provide a method for controlling an engine for a model which is capable of ensuring stable variation in rotational speed of the engine even when a degree of opening of a throttle valve is drastically varied.

It is another object of the present invention to provide a method for controlling an engine for a model which is capable of permitting the engine to exhibit satisfactory response to drastic variation in degree of opening of a throttle valve.

It is a further object of the present invention to provide a device for controlling an engine for a model which is capable of ensuring stable variation in rotational speed of the engine even when a degree of opening of a throttle valve is drastically varied.

It is still another object of the present invention to provide a device for controlling an engine for a model which is capable of permitting the engine to exhibit satisfactory response to drastic variation in degree of opening of a throttle valve.

In accordance with one aspect of the present invention, a method for controlling an engine for a model is provided wherein a degree of opening of a needle valve is automatically controlled so as to render a mixing ratio at which air and fuel are mixed together optimum when a degree of opening of a throttle valve of a carburetor of the engine is controlled. The method comprises the step of controlling the needle valve so as to provide a mixing ratio larger than the above-described optimum mixing ratio for a predetermined length of time, to thereby rapidly accelerate the engine, when the throttle valve is rendered open so as to increase a rotational speed of the engine.

In accordance with this aspect of the present invention, a method for controlling an engine for a model is provided wherein a degree of opening of a needle valve is automatically controlled so as to render a mixing ratio at which air and fuel are mixed together optimum when a degree of opening of a throttle valve of a carburetor of the engine is controlled. The method comprises the steps of controlling the needle valve so as to provide a first mixing ratio larger than the above-described optimum mixing ratio for a first predetermined length of time, to thereby rapidly accelerate the engine, when the throttle valve is rendered open so as to increase a rotational speed of the engine and controlling the needle valve so as to provide a second mixing ratio smaller than the optimum mixing ratio for a second predetermined length of time, to thereby rapidly decelerate the engine, when the throttle valve is closed so as to decrease the rotational speed.

In a preferred embodiment of the present invention, the first and second mixing ratios and the first and second predetermined lengths of time are adjusted.

In a preferred embodiment of the present invention, the method further comprises the step of executing a program for control algorithm by means of a signal processing unit, to thereby carry out control of the engine.

In accordance with another aspect of the present invention, a device for controlling an engine for a model is provided wherein a degree of opening of a needle valve is automatically controlled so as to render a mixing ratio at which air and fuel are mixed together optimum when a degree of opening of a throttle valve of a carburetor of the engine is controlled. The device includes a means for detecting a degree of opening of the throttle valve of the engine and a needle valve control means for controlling the needle valve to provide a mixing ratio larger than the above-described optimum mixing ratio before a predetermined period of time when the detection means detects opening of the throttle valve.

Also, in accordance with this aspect of the present invention, a device for controlling an engine for a model is provided wherein a degree of opening of a needle valve is automatically controlled so as to render a mixing ratio at which air and fuel are mixed together optimum when a degree of opening of a throttle valve of a carburetor of the engine is controlled. The device includes a means for detecting a degree of opening of the throttle valve of the engine and a needle valve control means for controlling the needle valve to provide a first mixing ratio larger than the above-described optimum mixing ratio before a first predetermined length of time when the detection means detects opening of the throttle valve and a second mixing ratio smaller than the optimum mixing ratio before a second predetermined length of time when the detection means detects closing of the throttle valve.

In a preferred embodiment of the present invention, the device further includes a means for adjusting each of the first and second mixing ratios and the first and second predetermined lengths of time.

The present invention, as described above, is so constructed that feed of fuel to the engine is increased during acceleration of the engine and decreased during deceleration thereof. Such construction permits a rotational speed of the engine to be smoothly and rapidly varied, to thereby reduce vibration of the engine and prevent knocking and breathing of the engine.

Also, in the present invention, adjustment of a trim provided on a side of a controller leads to adjustment of the needle valve, so that the adjustment may be facilitated.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Now, the present invention will be described hereinafter with reference to the accompanying drawings.

First, a construction associated with an engine for a model which is controlled by the present invention will be described hereinafter with reference to FIG. 1.

Figure 1:
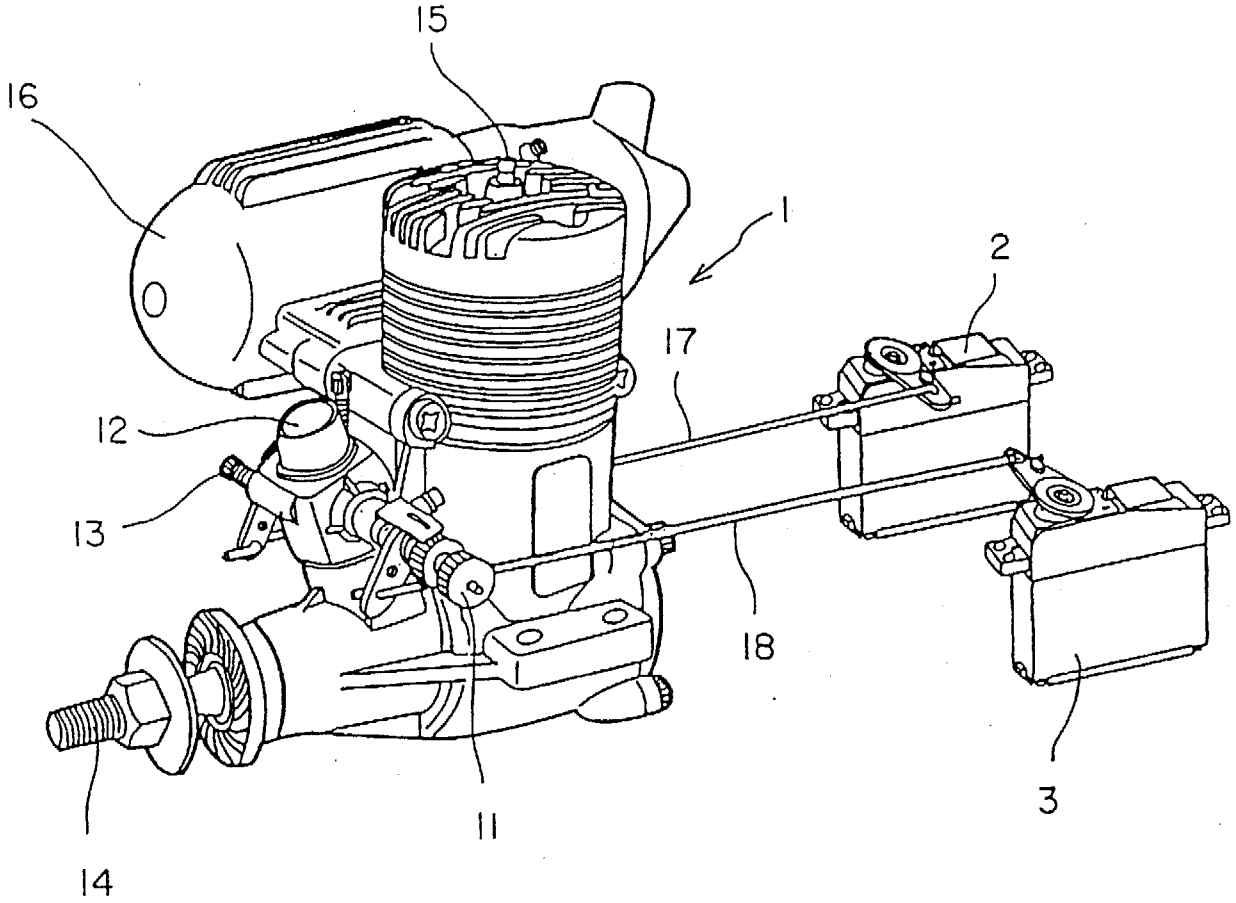
FIG. 1 is a perspective view generally showing an embodiment of a device for controlling an engine for a model according to the present invention.

In FIG. 1, reference numeral 12 designates a carburetor which is adapted to mix air and fuel with each other therein to form mixed gas and feed it to an engine 1 for a model such as a model airplane. For this purpose, the carburetor 12 is provided with a throttle valve 13 for adjusting the amount of air for the mixed gas and a needle valve 11 for adjusting the amount of fuel therefor. The mixed gas fed to the engine 1 is compressed therein, followed by ignition by means of an ignition plug 15, so that a piston (not shown) in the engine 1 is downwardly moved, to thereby rotate a crank shaft 14. When the engine 1 is mounted on a model airplane, the crank shaft 14 is mounted thereon with a propeller. Reference 16 designates a muffler for attenuating noise generated by the engine 1.

The model mounted engine 1 is also provided with a throttle servo 2 for controlling a degree of opening of the throttle valve 13 and a needle servo B for controlling a degree of opening of the needle valve 11. In order to thus control the model mounted engine 1 by means of the throttle servo 2 and needle servo 3, a radio control transmitter is so constructed that each one channel is allocated for control of each of the needle valve 11 and throttle valve 13, wherein application of mixing from the throttle valve channel to the needle valve channel results in the mixed gas prepared at a suitable mixing ratio being fed to the model mounted engine 1.

Figure 2:
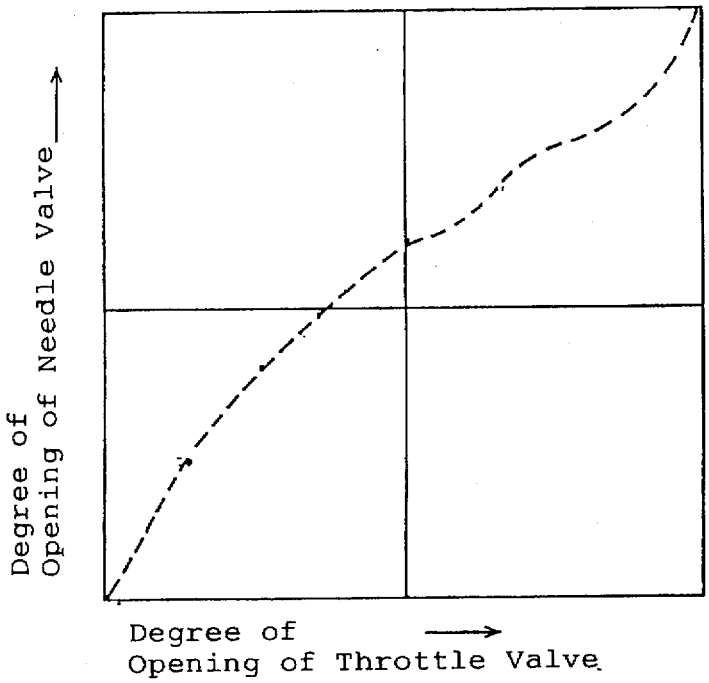
FIG. 2 is a graphical representation showing an example of characteristics of a degree of opening of a needle valve to that of a throttle valve in the device of FIG. 1.

Characteristics of a variation of a degree of opening of the needle valve 11 with respect to that of the throttle valve 13 for providing the mixed gas formed at a suitable mixing ratio are shown in FIG. 2 by way of example. The variation characteristics shown in FIG. 2 may be obtained by obtaining a suitable degree of opening of the needle valve 11 with respect to a degree of opening of the throttle valve 13 at each of several points such as, for example, seven points and connecting the degrees of opening of the needle valve obtained to each other in order to form a curve. A degree of opening of the needle valve may be obtained either with reference to the variation characteristics shown in FIG. 2 or by operation.

Figure 3:
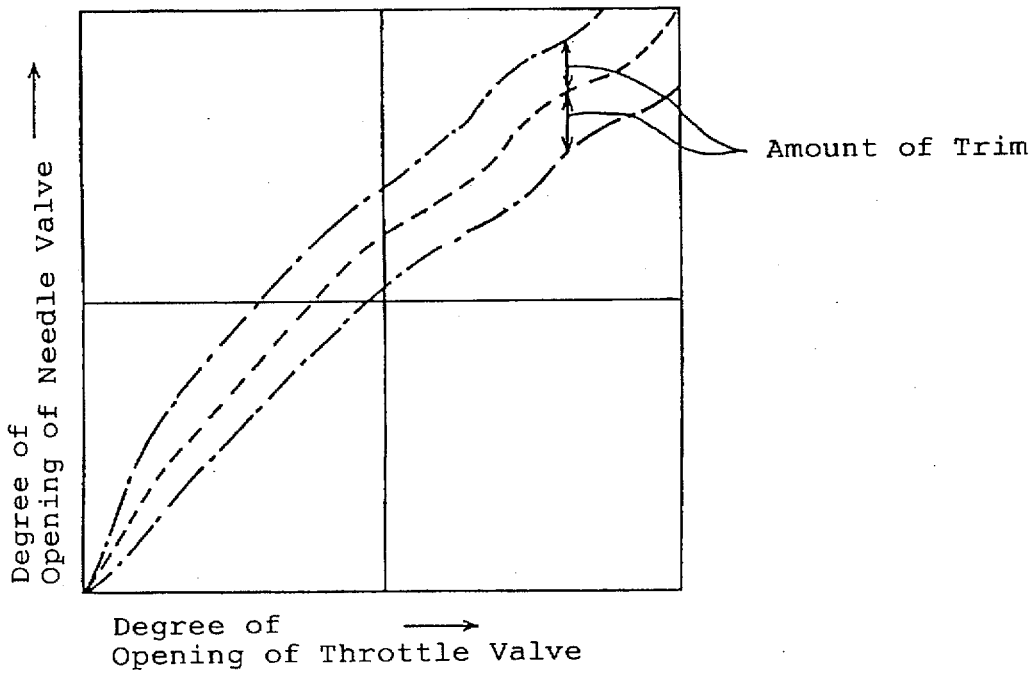
FIG. 3 is a graphical representation showing an example of characteristics of a degree of opening of a needle valve to that of a throttle valve which are displaceable in parallel in the device of FIG. 1.

Also, in view of the fact that fuel is varied in viscosity or the like depending on a temperature thereof or the like, the present invention is constructed so as to move or displace the variation characteristics shown in FIG. 2 to variation characteristics shown in FIG. 3. The amount of such movement or displacement (or the amount of trim) may be adjusted by operating a trim arranged on the radio control mechanism. Mixing from the throttle valve channel to the needle valve channel is in the form of programmable mixing of which the amount is variable.

Now, the radio control transmitter to which the model mounted engine control device of the present invention is applied will be described hereinafter with reference to FIG. 4 by way of example.

Figure 4:
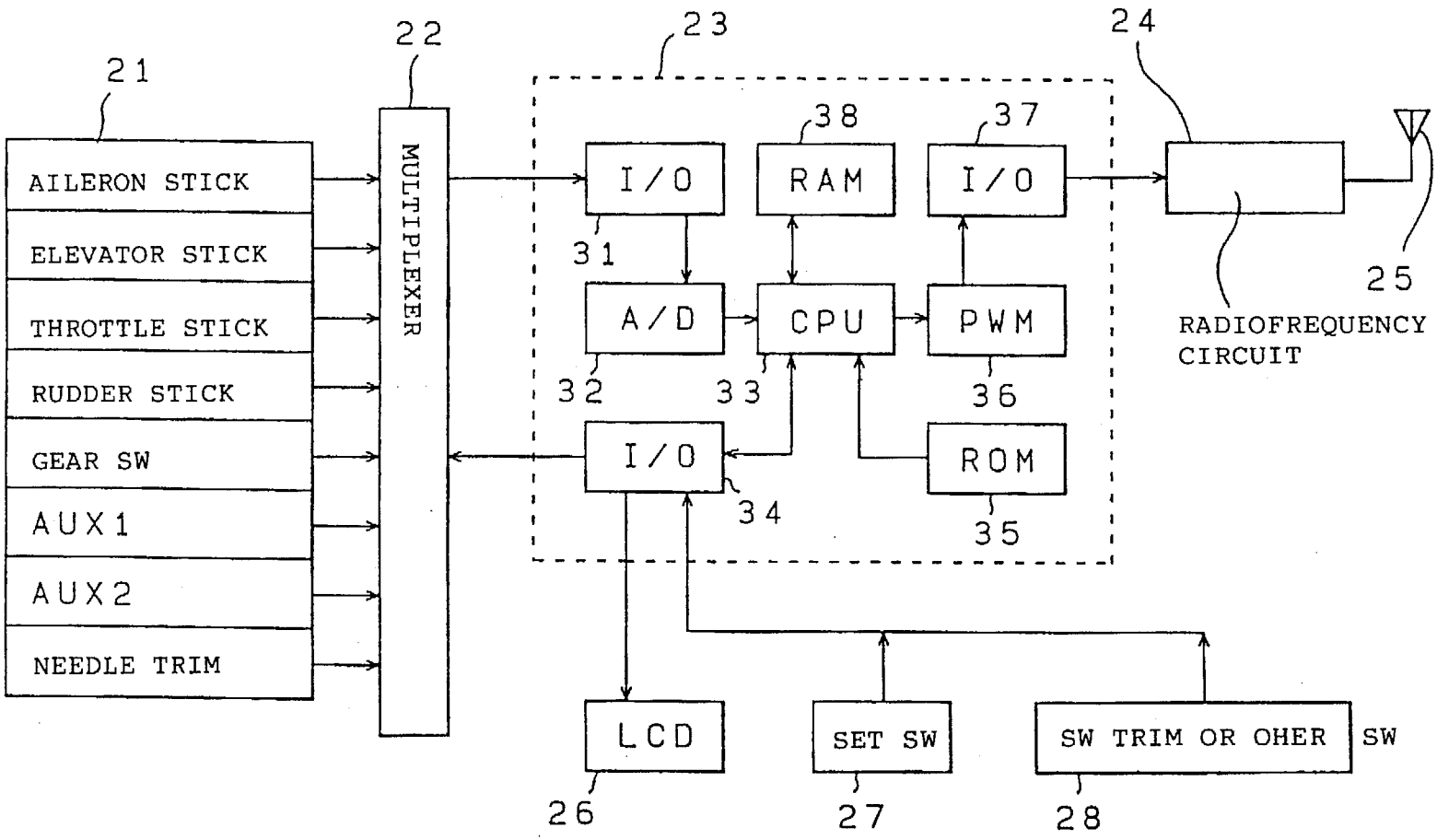
FIG. 4 is a block diagram showing an example of a radio control transmitter to which the present invention is applied.

The radio control transmitter, as shown in FIG. 4, generally includes a control section 21 including sticks and the like for controlling a model, a multiplexer 22 for multiplexing each of signals generated from the control section 21, a signal processing section 23 for carrying out processing of a control signal generated from the multiplexer 22 to control a pulse width of each of channels, and a radiofrequency module or circuit 24 for transmitting a PWM signal generated from the signal processing section 23.

When the radio control transmitter thus constructed is directed to a model airplane, the control section 21 includes an aileron stick for controlling a rudder angle of an aileron of a main wing, an elevator stick for controlling a rubber angle of an elevator of a horizontal tail, a throttle stick for controlling a degree of opening of the throttle valve, a rudder stick for controlling a rudder angle of a rudder of a vertical tail, a gear switch, reserve sticks AUX 1 and AUX 2, and a needle trim for displacing in parallel variation characteristics of a degree of opening of the needle valve with respect to that of the throttle valve. Such components of the control section 21 each generate an output signal, which is subject to time division multiplex by the multiplexer 22, so that it generates a multiplexed signal.

The multiplexed signal thus generated from the multiplexer 22 is fed through an input/output interface (I/O) to an analog/digital conversion section (A/D) 32 of the signal processing section 23 for every channel, resulting in being converted into a digital signal, followed by signal processing in a central processing unit (CPU) 33. An operation program for the CPU 33 is stored in a read only memory (ROM) 35, so that the CPU 33 executes the program stored in the ROM 35 while using a random access memory (RAM) 38 as a work area.

Upon termination of the signal processing, the signal is fed to a pulse width modulation (PWM) means 36, to thereby be formed into a pulse width depending on data outputted from the CPU 33, so that a PWM signal is outputted from the PWM means 36 through an input-output interface (I/O) 37. The PWM signal is then fed to the radiofrequency module or circuit 24, in which a carrier is modulated by the PWM signal and then transmitted from an antenna 25.

The signal processing section 23 also feeds a signal through an input/output interface (I/O) 34 to the multiplexer 22. Also, the signal processing section 23 feeds a display signal through the I/O 34 to a liquid crystal display section (LCD) 26, so that predetermined display is carried out on the LCD 26 when various parameters are set. The I/O 34 is fed with a signal from each of a switch 27 for setting various parameters and a switch trim or other switch 28, so that the signals of the switches 27 and 28 may be introduced into the signal processing section 23.

When the throttle stick of the control section 21 is operated to rapidly vary a degree of opening of the throttle valve, such processing as described below takes place in the signal processing section 23, so that a degree of opening of the needle valve is controlled. Thus, it will be noted that the signal processing section 23 corresponds to a model mounted engine control device of the present invention.

Now, a method for controlling an engine for a model according to the present invention which is executed in the signal processing section 23 will be described hereinafter.

Figure 5:
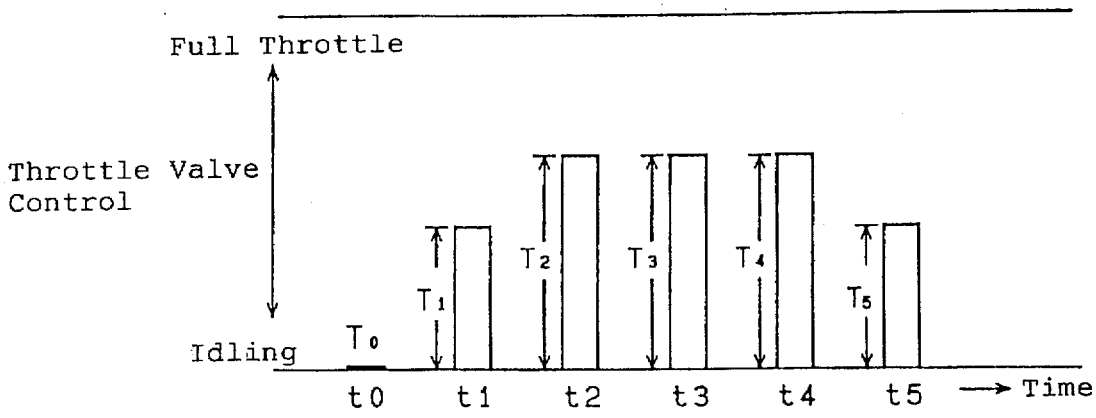
FIG. 5 is a diagrammatic view showing a variation of control of a throttle valve with time in the present invention.

FIG. 5 shows throttle data indicating the amount of control of the throttle valve obtained when the throttle stick is operated, which throttle data correspond to the amount of operation of the throttle stick of the control section 21. In FIG. 5, at time t0, the amount of control of the throttle valve is indicated at throttle data T0 at which the engine is kept idling. At time t1, the amount of control of the throttle valve is increased as indicated by throttle data T1, to thereby be controlled so as to increase a rotational speed of the engine. Also, at time t2, the amount of control of the throttle valve is further increased to a level of throttle data T2. This indicates that the amount is controlled so as to further increase a rotational speed of the engine. During a period from the time t2 to time t4, the amount of control of the throttle valve is kept at a level of the throttle data T2 and then at time t5, the amount of control of the throttle valve is decreased to throttle data T5. Thus, at the time t5, the throttle valve is controlled so as to decelerate the engine.

Figure 6:
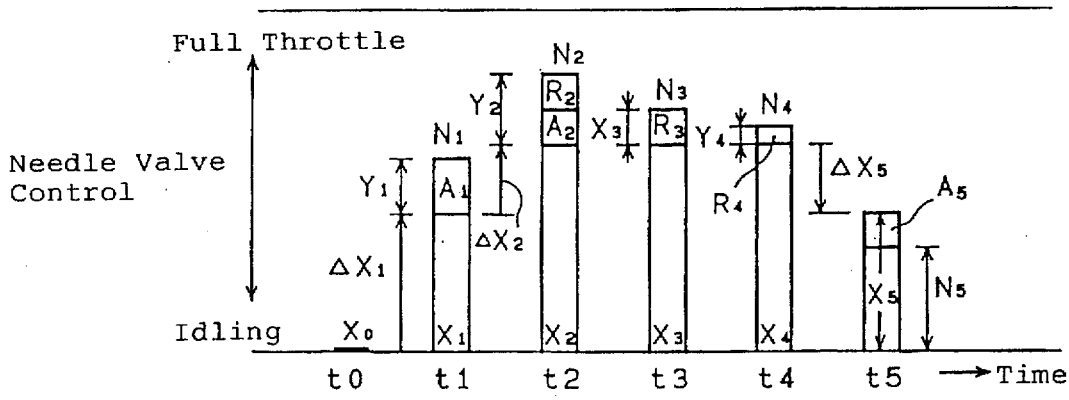
FIG. 6 is a diagrammatic view showing a variation of needle mix data for controlling a needle valve with time when throttle data are varied with time as shown in FIG. 5 in the present invention.

FIG. 6 shows a variation of needle data Xn for controlling a degree of opening of the needle valve operated in the signal processing section 23, which variation occurs when throttle data Tn for controlling a degree of opening the throttle valve are varied as shown in FIG. 5. In FIG. 6, at time t0, the amount of control of the needle valve is at a level indicated by needle data X0 at which the engine is kept idling. At time t1, the amount of control of the needle valve is operated depending on the amount of control of the throttle valve, so that needle data X1 may be obtained depending on variation characteristics of the degree of opening of the needle shown in FIG. 3. In this instance, acceleration data A1 obtained by operation are added to the needle data X1 to provide needle mix data N1. Thus, at the time t1, a degree of opening of the needle valve is controlled depending on the needle mix data N1 thus provided.

In this instance, a needle data variation quantity ΔX1 is determined by subtracting the previous needle data X0 from the present needle data X1, and at the time t1, return data R1 are rendered zero at the time t1 and mix data Y1 are rendered equal to the acceleration data A1. Thus, at the time t1, the needle mix data N1 has the acceleration data A1 added thereto, so that the engine is fed with mixed gas obtained at a mixing ratio larger than a suitable or appropriate mixing ratio, resulting in a rotational speed of the engine being rapidly increased.

Also, at time t2, needle data X2 are obtained by operation carried out in the same manner as described above, which are increased by a needle data variation quantity ΔX2 as compared with those at the time t1. Further, in this instance, acceleration data A2 and return data R2 are added to the needle data X2, resulting in needle mix data N2 being provided. Accordingly, the needle valve is controlled so as to be further open, so that a rotational speed of the engine is further rapidly increased.

This permits throttle response to be substantially improved.

Then, at time t3, the amount of control of the needle valve is indicated by needle data X3 which are the same as the needle data X2 obtained at the time t2. In this instance, return data R3 are added to the needle data X3, to thereby provide needle mix data N3.

At time t4, the amount of control of the needle valve is indicated by needle data X4 which are the same as the needle data X2 at the time t2, wherein return data R4 are added to the needle data X4, to thereby provide needle mix data N4.

At time t5 subsequent to the time t4, needle data X5 are obtained by operation carried out in the same manner as described above, which are decreased by a needle data variation quantity ΔX5 as compared with the needle data X4. In this instance, acceleration data A5 are subtracted from the needle data X5, resulting in needle mix data N5 being obtained. This permits the needle valve to be further closed from a degree of opening of the needle valve smaller than that at which a suitable mixing ratio is provided, so that a rotational speed of the engine may be rapidly decreased.

Thus, the present invention is so constructed that when the amount of control for controlling a degree of opening of the throttle valve is varied so as to be increased, mixed gas at a mixing ratio larger than a suitable mixing ratio is provided; whereas when the amount of the control is varied in a direction of being decreased, mixed gas at a mixing ratio smaller than the suitable mixing ratio is provided. Such construction of the present invention contributes to a significant improvement in throttle response.

Figure 7:
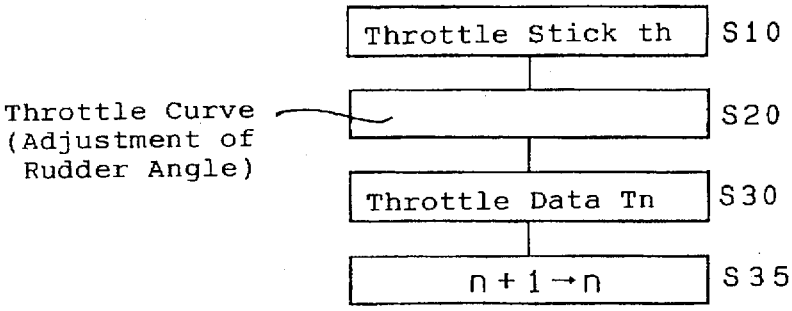
FIG. 7 is a flow chart showing throttle processing in the present invention.
Figure 8:
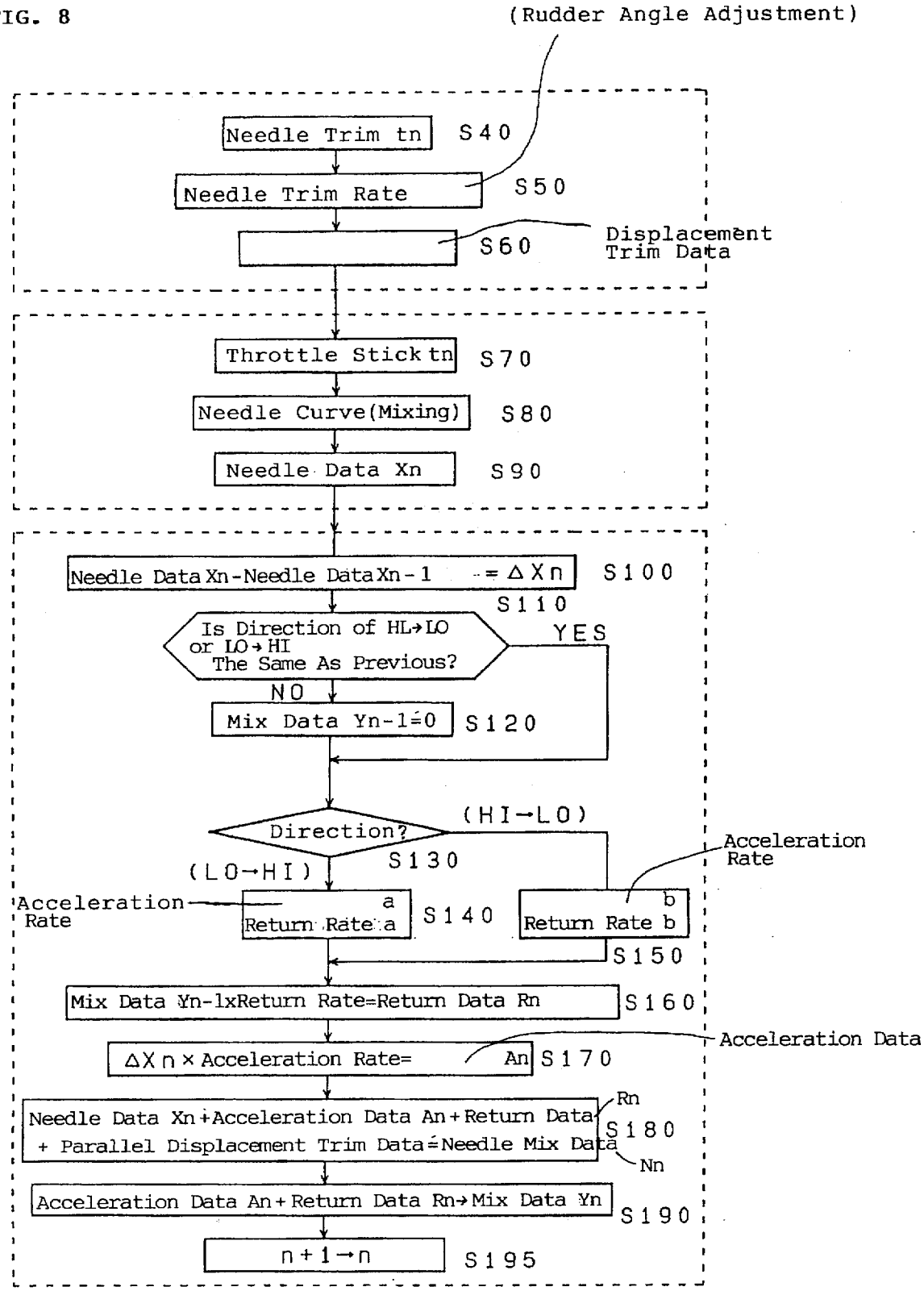
FIG. 8 is a flow chart showing needle processing in the present invention.

Now, the above-described processing in the signal processing section 23 by operation will be further described hereinafter with reference to FIGS. 7 and 8, wherein FIG. 7 is a flow chart for throttle processing and FIG. 8 is a flow chart for needle processing.

In FIG. 7, when the throttle processing is initiated at time tn, the amount of operation of the throttle stick at that time is detected in a step S10 and a throttle curve preset in a step S20 is referred to, so that throttle data Tn depending on the amount of operation of the throttle stick detected in a step S30 may be obtained. Then, n is incremented by one in a step S35 for next throttle processing.

This results in the throttle processing being terminated, followed by next throttle processing. In this instance, when the throttle processing is executed at time t1, throttle data T1 shown in FIG. 5 are obtained at the time t1; whereas when it is executed at time t2, throttle data T2 are obtained. Similarly, throttle data T3, T4 and T5 are obtained at time t3, time t4 and time t5, respectively.

In FIG. 8, needle processing which is initiated at time tn is first executed in order to obtain a needle trim. More particularly, the amount of operation of the needle trim is detected in a step S40 and a needle trim rate depending on the amount of operation of the needle trim detected is obtained in a step S50. Then, in a step S60, parallel displacement trim data are obtained depending on the needle trim rate. This causes a needle curve to be subject to parallel displacement depending on the amount of operation of the needle trim within a range shown in FIG. 3.

Thereafter, in a step S70, the amount of operation of a throttle stick at time tn is detected and then in a step S80, a needle curve preset as shown in FIG. 3 is referred to, so that needle data Xn depending on the amount of operation of the throttle stick are obtained in a step S90.

Subsequently, in a step S100, data obtained by subtracting needle data Xn−1 at time tn−1 immediately forward of time tn from needle data Xn at the time tn are obtained in the form of a needle variation quantity ΔXn. Then, in a step S110, it is judged whether or not a direction of a variation of the needle data Xn which is carried out so as to cause an engine speed to be either decreased (HI→LO) or increased (LO→HI) is the same as that at the previous time. When this is judged to be "YES", a step S130 is executed; whereas when it is judged to be "NO", mix data Yn−1 are reset to be zero in a step S120 and then the step S130 is executed.

Thus, in the step S130, it is judged whether the direction in which the needle data Xn are varied is HI→LO or LO→HI. As a result, when it is judged to be LO→HI, an acceleration rate and a return rate are considered to be data a in a step S140; whereas when the direction is judged to be HI→LO, the acceleration rate and return rate are considered to be data b in a step S150. Then, in a step S160, the mix data Yn−1 at the previous time are multiplied by the return rate a or b, resulting in return data Rn being provided.

Then, in a step S170, the needle data variation quantity ΔXn is multiplied by the acceleration rate a or b, to thereby provide acceleration data An.

Further, in a step S180, the needle data Xn, acceleration data An and return data Rn are added to each other together with the parallel displacement trim data obtained in the step S60, so that needle mix data Nn are obtained. This results in the needle mix data Nn reflecting the parallel displacement trim data obtained in the step S60, so that a degree of opening of the needle valve is controlled by the needle mix data Nn. Then, in a step S190, a value obtained by adding the acceleration data An and return data Rn to each other constitutes mix data Yn, wherein n is incremented by one in the step S195 for the next needle processing.

Thus, the needle processing is completed and a needle processing subsequent thereto takes place. Various kinds of processings are executed in the signal processing section 23, wherein the above-described throttle processing and needle processing are repeatedly executed at predetermined timings. The execution takes place at times t0, t1, t2, t3, t4, - - - . A cycle of a plurality of processings including the throttle processing and needle processing which are circulatedly executed in turn may be, for example, 28.5 msec and the processings each are executed once at every cycle.

Now, the needle mix data shown in FIG. 6 will be described hereinafter for every time of from time t0 to time t5 with reference to FIG. 8.

(1) Time t0:

Parallel displacement trim data set by a user are obtained in steps S40 to S60 and throttle data T0 depending on a position of operation of the throttle stick at time t0 are obtained in steps S70 to S90, so that needle data X0 which correspond to the throttle data T0 are obtained with reference to such a needle curve as shown in FIG. 3. In this instance, the engine is kept idling at the time t0, so that the throttle data T0 and needle data X0 at that time each are permitted to have a reference value of 0 because they are kept from having a lower value.

Then, in a step S100, a needle data variation quantity ΔX0 is operated, wherein the time t0 is regarded as initial time and the needle data X0 are zero, resulting in the needle data variation quantity ΔX0 being likewise zero. Subsequent steps S110 to S150 each do not have any previous time, so that processing is advanced to a step S160 and steps subsequent thereto in order without carrying out any judgment. In this instance, mix data Yn−1 at the previous time are zero and the needle data variation quantity ΔX0 is likewise zero, resulting in return data R0 and acceleration data A0 operated in the step S160 and a step S170 being zero. Then, needle mix data N0 operated in a step S180 have a value equal to that of the parallel displacement trim data and mix data Y0 operated in a step S190 are rendered zero. Then, the mix data Y0 are subject to processing in a step S195 so that n is incremented by one, resulting in being one. The mix data Y0 are ready for subsequent processing at subsequent time t1.

(2) Time t1:

The same processing as described above is carried out between steps S40 and S90. Termination of processing in the step S90 results in needle data X1 at time t1 being provided. In a subsequent step S100, the needle data X0 at the previous time t0 is subtracted from the needle data X1, so that a needle data variation quantity ΔX1 is provided. Then, it is judged whether or not a direction of the variation is the same as that at the previous time. However, no direction is at the previous time t0, so that processing is advanced to a step S130 without carrying out any judgment on the direction. At the time t1, throttle data are increased to a level T1, so that judgment that the variation direction is LO→HI is made in the step S130. Then, processing is advanced to a step S140, wherein an acceleration rate and a return rate constitute data a.

Thereafter, mix data Y0 which are rendered zero in a step S160 are multiplied by the return date a, so that return data R1 which are zero may be obtained. In a subsequent step S170, the needle data variation quantity ΔX1 is multiplied by the acceleration rate a, resulting in acceleration data A1 being provided. Further, in a step S180, the needle data X1, the acceleration data A1 and parallel displacement trim data are added to each other, so that needle mix data N1 shown in FIG. 6 may be obtained. In FIG. 6, the parallel displacement trim data are not shown for the sake of brevity.

Then, in a step S190, the acceleration data A1 are obtained in the form of mix data Y1 shown in FIG. 6. Thereafter, in a step S195, n is incremented to 2.

(3) Time t2:

Between steps S40 and S90, processing takes places in the same manner as described above. When processing in the step S90 is completed, needle data X2 at time t2 are obtained. In a subsequent step S100, the needle data X1 at the previous time t1 are subtracted from the needle data X2, resulting in a needle data variation quantity ΔX2 being provided. Then, it is judged whether or not a direction of the variation is the same as that at the previous time. In this instance, judgment of "YES" indicating that the direction is the same is made, so that processing is advanced to a step S130. At the time t2, throttle data are further increased to T2, therefore, the variation direction is judged to be LO→HI in the step S130, followed by transfer of processing to a step S140, wherein an acceleration rate and a return rate constitute data a.

Subsequently, in a step S160, the mix data Y1 at the previous time are multiplied by the return rate a, to thereby provide return data R2 shown in FIG. 6. In a subsequent step S170, the needle data variation quantity ΔX2 is multiplied by the acceleration rate a, so that acceleration data A2 shown in FIG. 6 are obtained. Also, in a step S180, the needle data X2, acceleration data A2 and parallel displacement trim data are added to each other, resulting in needle mix data N2 shown in FIG. 6 being provided.

Further, in a step S190, the return data R2 are added to the acceleration data A2 to provide mix data Y2 shown in FIG. 6. Then, in a step S195, n is incremented by one to 3.

(4) Time t3:

Needle processing at time t3 is carried out in substantially the same manner as that at the previous time t2. Thus, the following description will be made in connection with a step S160 and steps subsequent thereto.

In the step S160, the mix data Y2 at the previous time are multiplied by a return rate a, to thereby provide return data R3 shown in FIG. 6. In a subsequent step S170, a needle data variation quantity ΔX3 is multiplied by an acceleration rate a. In this instance, the needle data variation quantity ΔX3 is zero, therefore, acceleration data A3 are rendered zero. Also, in a step S180, needle data X3, the acceleration data A3 and parallel displacement trim data are added to each other, so that needle mix data N3 shown in FIG. 6 may be obtained.

In a step S190, the return data R3 are obtained in the form of mix data Y3 shown in FIG. 6. Then, in a step S195, n is incremented to 4.

(5) Time t4:

Needle processing at time t4 is carried out in substantially the same manner as that at the previous time t3. Thus, the following description will be made in connection with a step S160 and steps subsequent thereto.

In the step S160, the mix data Y3 at the previous time are multiplied by a return rate a, to thereby provide return data R4 shown in FIG. 6. In a step S170 subsequent thereto, a needle data variation quantity ΔX4 is multiplied by an acceleration rate a. In this instance, the needle data variation quantity ΔX4 is zero, so that acceleration data A4 are rendered zero. Also, in a step S180, needle data X4, the acceleration data A4 and parallel displacement trim data are added to each other, so that needle mix data N4 shown in FIG. 6 may be obtained.

In a step S190, the return data R4 are obtained in the form of mix data Y4 shown in FIG. 6. Then, in a step S195, n is incremented to 5.

(6) Time t5:

Between steps S40 and S90, processing takes places in the same manner as described above. When processing in the step S90 is completed, needle data X5 at time t5 are obtained. In a subsequent step S100, the needle data X4 at the previous time are subtracted from the needle data X5, resulting in a needle data variation quantity ΔX5 being provided. At this time, the needle data variation quantity ΔX5 is negative as noted from FIG. 6. Then, it is judged whether or not a direction of the variation is the same as that at the previous time. In this instance, judgment of "NO" indicating that the direction is opposite is made because the needle data variation quantity ΔX5 is negative, so that processing is advanced to a step S120, resulting in the mix data at the previous time T4 being reset to be zero. Then, a direction of the variation is judged in a step S130. At the time t5, throttle data are decreased to T5, therefore, the variation direction is judged to be HI→LO in the step S130, followed by transfer of processing to a step S150, wherein an acceleration rate and a return rate constitute data a.

Subsequently, in a step S160, the mix data Y4 at the previous time are multiplied by the return rate b, to thereby provide return data R5. In this instance, the mix data Y4 at the previous time are kept reset, so that the return data R5 are rendered zero. In a subsequent step S170, the needle data variation quantity ΔX5 is multiplied by the acceleration rate b, so that acceleration data A5 shown in FIG. 6 are obtained. In this instance, the needle data variation quantity ΔX5 is negative, so that the acceleration data A5 are rendered negative. Also, in a step S180, the needle data X5, acceleration data A5 and parallel displacement trim data are added to each other, resulting in needle mix data N5 shown in FIG. 6 being provided. In this instance, the acceleration data A5 are negative, so that the needle mix data N5 are reduced by a value corresponding to the acceleration data A5 as compared with the needle data X5.

Further, in a step S190, the negative acceleration data A5 are obtained in the Form of negative mix data Y5. Then, in a step S195, n is incremented by one to 6.

Thereafter, needle processing takes place at each of time t6 and subsequent times. As will be noted from FIG. 6, as well as the above description, an increase in throttle data Tn for the purpose of increasing an engine speed (corresponding to the time t1 and time t2 in FIG. 6) causes the acceleration data An or the acceleration data An and return data Rn to be immediately added to the needle data, resulting in the needle mix data Nn being provided. The needle mix data Nn act to control a degree of opening of the needle valve of the engine, so that the engine may be controlled so as to be accelerated, leading to a rapid increase in engine speed. Thus, the throttle response is improved.

Also, when the throttle data Tn once increased are kept increased (corresponding to the time t2 to time t4 in FIG. 6), the acceleration data An added to the needle data Xn are rendered zero, whereas the return data are gradually decreased to a level of substantially zero because the mix data Yn−1 at the previous time are multiplied by the return rate a of the return data which is 1 or less at every time. The engine is increased in rotational speed thereof to a desired level at the time when the return data Rn are rendered substantially zero, so that a mixing ratio of the mixed gas being fed to the engine may have an optimum value obtained from FIG. 3.

Further, a decrease in throttle data Tn for reducing a rotational speed of the engine (corresponding to the time t5 in FIG. 6) causes the acceleration data An to be instantaneously subtracted from the needle data Xn, to thereby provide the needle mix data Nn. The needle mix data Nn thus provided act to control a degree of opening of the needle valve of the engine, so that the engine may be controlled so as to be further decelerated, leading to a rapid decrease in rotational speed of the engine. Thus, the throttle response is likewise improved.

The acceleration rate and return rate each are set to be a different value depending on displacement of the engine, a type of the engine or the like. Also, characteristics of an increase in rotational speed of the model mounted engine and those of the decrease are generally considered to be different from each other; so that the acceleration rate and return rate are indicated by different values a and b, respectively.

Also, the model mounted engine control method of the present invention is illustrated in the form of control algorithm shown in FIGS. 7 and 8 by way of example. The model mounted engine control device of the present invention may be realized in the form of a signal processing device such as a CPU or the like which executes the control algorithm as a program therefor. Alternatively, the control algorithm may be realized by means of a hardware.

As can be seen from the foregoing, the present invention permits a feed rate of fuel to the engine to be increased during acceleration of the engine and decreased during deceleration thereof, resulting in a rotational speed of the engine being smoothly and rapidly varied. Thus, the present invention minimizes vibration of the engine and substantially prevents knocking and breathing of the engine.

Also, the present invention is so constructed that adjustment of the adjustment means (trim) arranged on the control side leads to needle adjustment. Such construction facilitates the adjustment.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A method for remotely controlling a model-mountable internal combustion engine having a carburetor, a throttle valve and a needle valve, comprising the steps of:

forming a signal arranged to automatically control an amount of opening of said needle valve in response to a change in a degree of opening of said throttle valve when said signal is transmitted to said engine, said forming step comprising, identifying an optimum mixing ratio of air and fuel for said carburetor based on said degree of opening of said throttle valve, detecting an increase in said opening of said throttle valve, identifying another mixing ratio larger than said optimum mixing ratio for a predetermined period of time so as to cause said engine to rapidly accelerate when said another mixing ratio is applied to said carburetor, and including an indicator of said another mixing ratio in said signal;

transmitting said signal to said engine; and controlling the amount of opening of said needle valve in response to said indicator of said another mixing ratio in said signal.

2. A method for remotely controlling a model-mountable internal combustion engine having a carburetor, a throttle valve and a needle valve, comprising the steps of:

forming a signal arranged to automatically control an amount of opening of said needle valve in response to a change in a degree of opening of said throttle valve when said signal is transmitted to said engine, said forming step comprising, identifying an optimum mixing ratio of air and fuel for said carburetor based on said degree of opening of said throttle valve, detecting a change in said degree of opening of said throttle valve, identifying another mixing ratio so as to rapidly change one of an engine acceleration and an engine deceleration when said another mixing ratio is applied to said carburetor, said identifying step comprising, identifying a first mixing ratio as said another mixing ratio for a first predetermined period of time when said detecting step detects a further opening of said degree of opening, said first mixing ratio being larger than said optimum mixing ratio so as to increase a rotational speed of said engine, and identifying a second mixing ratio as said another mixing ratio for a second predetermined period of time when said detecting step detects a further closing of said degree of opening, said second mixing ratio being smaller than said optimum mixing ratio so as to decrease the rotational speed of said engine, including an indicator of said another mixing ratio in said signal;

transmitting said signal to said engine; and controlling the amount of opening of said needle valve in response to said indicator of said another mixing ratio in said signal.

3. The method of claim 2, further comprising the step of adjusting at least one of said first predetermined period of time and said second predetermined period of time.

4. The method as in one of claims 1–3, further comprising the step of performing said step of forming a signal in a signal processing unit.

5. A device for remotely controlling a model-mountable internal combustion engine having a carburetor, a throttle valve and a needle valve, comprising:

means for forming a signal arranged to automatically control said needle valve in response to a change in a degree of opening of said throttle valve when said signal is transmitted to said engine, comprising, means for identifying an optimum mixing ratio of air and fuel for said carburetor based on said degree of opening of said throttle valve, means for detecting an increase in said opening of said throttle valve, means for identifying another mixing ratio larger than said optimum mixing ratio for a predetermined period of time so as to cause said engine to rapidly accelerate when said another mixing ratio is applied to said carburetor, and means for including an indicator of said another mixing ratio in said signal;

means for transmitting said signal to said engine; and means for controlling an amount by which said needle valve is opened in response to said indicator of said another mixing ratio in said signal.

6. A device for remotely controlling a model-mountable internal combustion engine having a carburetor, a throttle valve and a needle valve, comprising:

means for forming a signal arranged to automatically control said needle valve in response to a change in a degree of opening of said throttle valve when said signal is transmitted to said engine, comprising, means for identifying an optimum mixing ratio of air and fuel for said carburetor based on said degree of opening of said throttle valve, means for detecting a change in said degree of opening of said throttle valve, means for identifying another mixing ratio so as to rapidly change one of an engine acceleration and an engine deceleration when said another mixing ratio is applied to said carburetor, comprising, means for identifying a first mixing ratio as said another mixing ratio for a first predetermined period of time when said means for detecting detects a further opening of said degree of opening, said first mixing ratio being larger than said optimum mixing ratio so as to increase a rotational speed of said engine, and identifying a second mixing ratio as said another mixing ratio for a second predetermined period of time when said means for detecting detects a further closing of said degree of opening, said second mixing ratio being smaller than said optimum mixing ratio so as to decrease the rotational speed of said engine, means for including an indicator of said another mixing ratio in said signal;

means for transmitting said signal to said engine; and means for controlling an amount by which said needle valve is opened in response to said indicator of said another mixing ratio in said signal.

7. The device of claim 6, further comprising means for adjusting at least one of said first predetermined period of time and said second predetermined period of time.

8. A device for remotely controlling a model-mountable internal combustion engine having a carburetor, a throttle valve and a needle valve, comprising:

a signal processor configured to execute a software program that produces a signal arranged to automatically control said needle valve in response to a change in a degree of opening of said throttle valve when said signal is transmitted to said engine, comprising, a first identification mechanism configured to identify an optimum mixing ratio of air and fuel for said carburetor based on said degree of opening of said throttle valve, a detection mechanism configured to detect said degree of opening of said throttle valve, a second identification mechanism configured to identify another mixing ratio larger than said optimum mixing ratio for a predetermined period of time so as to cause said engine to rapidly accelerate when said another mixing ratio is applied to said carburetor, and an indicator mechanism configured to include indicator of said another mixing rato in said signal;

a transmitter configured to transmit said signal to said engine; and a needle valve control mechanism configured to control an opening amount of said needle in response to said indicator of said another mixing ratio transmitted in said signal.

9. The device of claim 8, further comprising:

a third identification mechanism configured to identify a third mixing ratio smaller than said optimum mixing ratio for a predetermined period of time so as to cause said engine to rapidly decelerate when applied to said carburetor in place of said another mixing ratio.

* * * * *